US007177585B2

(12) United States Patent
Matsuzaka et al.

(10) Patent No.: US 7,177,585 B2
(45) Date of Patent: Feb. 13, 2007

(54) IMAGE FORMING APPARATUS AND METHOD

(75) Inventors: Satoshi Matsuzaka, Ebina (JP); Keiji Yamamoto, Ebina (JP); Satoru Torimaru, Ebina (JP); Takashi Kawabata, Ebina (JP); Masaaki Takahashi, Ebina (JP); Yoko Miyamoto, Ebina (JP); Kiyotoshi Kaneyama, Ebina (JP); Katsunori Kikuchihara, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/682,964

(22) Filed: Oct. 14, 2003

(65) Prior Publication Data

US 2004/0184853 A1 Sep. 23, 2004

(30) Foreign Application Priority Data

Mar. 17, 2003 (JP) ..... 2003-071290

(51) Int. Cl.
*G03G 15/00* (2006.01)

(52) U.S. Cl. ..... 399/394; 399/388

(58) Field of Classification Search ..... 399/394, 399/388, 374, 364, 372
See application file for complete search history.

(56) References Cited

U.S. PATENT DOCUMENTS 4,721,381 A * 1/1988 Matsuo ..... 399/14
5,155,540 A * 10/1992 Yamada et al. ..... 399/402
5,160,946 A * 11/1992 Hwang ..... 347/116
5,253,031 A * 10/1993 Kinoshita et al. ..... 399/72
5,488,458 A * 1/1996 Benedict et al. ..... 399/15
6,333,774 B1 * 12/2001 Ito et al. ..... 355/26
6,374,075 B1 * 4/2002 Benedict et al. ..... 399/395
6,419,222 B1 * 7/2002 Morrison et al. ..... 271/186
6,782,236 B2 * 8/2004 Sasaki et al. ..... 399/401

FOREIGN PATENT DOCUMENTS

JP 5-88479 4/1993

* cited by examiner

*Primary Examiner*—Anthony H. Nguyen
(74) *Attorney, Agent, or Firm*—Morgan, Lewis & Bockius, LLP

(57) ABSTRACT

An image forming apparatus registers both sides of sheets with great precision in a sheet transportation direction in both-side image formation. The image forming apparatus includes: photoconductive drums holding toner images; an intermediate transfer belt temporarily holding the toner images; a secondary transfer roll that transfers the toner images to a sheet in a transfer unit; a registration roll rotating toward the transfer unit being in sheet feeding timing; a fixing unit fixing the toner images transferred to a first side of the sheet; reversion transportation paths reversing the sheet and again transporting the sheet to the transfer unit; a first sensor detecting the image of the first side of the sheet; and a second sensor that detects the toner images held in the intermediate transfer belt.

13 Claims, 9 Drawing Sheets

IMAGE FORMING APPARATUS AND METHOD

BACKGROUND OF THE INVENTION

1. Field of the Invention

The present invention relates to an image forming apparatus and method used for a copier, facsimile, and printer, and more particularly to an image forming apparatus having a double side image formation mode in which images are formed on both sides of a sheet and a method therefor.

2. Description of Related Art

Image forming apparatuses such as printers, copiers, and facsimiles are proposed to be of full-color, tandem type to form color images at high speed and with high quality. A typical tandem image forming apparatus includes four image forming units for yellow (Y), magenta (M), cyan (C), and black (K) disposed in parallel to each other in which toner images of yellow, magenta, cyan, and black are successively formed, transfers (primary transfer) the toner images onto an intermediate transfer belt serving as an intermediate transfer member, then collectively transfers (secondary transfer) the toner images from the intermediate transfer belt onto a transfer sheet, and fixes the toner images formed on the transfer sheet, thereby forming full-color and black-and-white (monochromatic) images.

Generally, the image forming apparatuses employ a so-called double-sided printing technique of forming images on both sides of a sheet (transfer sheet). According to this technique, when images are formed on both sides by, e.g., a full-color tandem apparatus, after a color toner image to be formed on one side (first side) of a sheet is formed on the intermediate transfer belt, the image is subjected to secondary transfer to and fixed onto the side of the sheet, the sheet is temporarily housed in a double side reversion feeding apparatus, the sheet is again fed from the double side reversion feeding apparatus while taking a timing with a color toner image on another side of the sheet formed on the intermediate transfer belt, and the another color image is subjected to secondary transfer to and fixed onto another side (second side) of the sheet. Some image forming apparatuses employ a belt transportation technique that, without using the intermediate transfer belt, transports sheets onto a transportation belt and successively transfers toner images from photoconductive drums to the sheets. Also in such apparatuses, after performing transfer and fixing to one side of a sheet, the sheet is reversed by the double side reversion feeding apparatus, and toner images are successively transferred and fixed to another side of the sheet transported on the transportation belt, whereby images can be formed on both sides.

In such conventional image forming apparatuses forming images on both sides, when a color image is formed on each side of a sheet, secondary transfer (or transfer to sheets transported on the transportation belt) to the sheet from the intermediate transfer belt and fixing of toner images must be performed for each side, and the sheet must be temporarily housed in the double side reversion feeding apparatus. For this reason, excessively long processing time has been problematic. Accordingly, an image forming apparatus forwardly and backwardly rotating photoreceptors to form images on both sides is adopted which forms an image on the back when the photoreceptors are switched from forward rotation to backward rotation, thereby reducing time for switching between recording of a first image and recording of a second image (see, e.g., Patent Reference 1).

[Patent Reference 1] Japanese Published Unexamined Patent Application No. Hei 5-88479 (pages 2 and 3, FIG. 1)

In recent years, a study has been made of the evolution of full-color image forming apparatuses employing the electrophotographic system as an alternative to offset printing used in the publication industry and the like. In the evolution of such full-color image forming apparatuses, high image quality comparable to that of offset printing is demanded, and the formation of images on both sides of a sheet requires addressing new problems that have been conventionally trivial.

FIGS. 8A and 8B are diagrams for explaining problems in the formation of images on both sides of a sheet. FIG. 8A shows an image formation state on a first side, and FIG. 8B shows an image formation state on a second side. In FIGS. 8A and 8B, register marks used in the printing industry and the like are formed. The register marks are widely used to correctly align multicolored images or as cutoff lines, for example. Image forming apparatuses generally perform positioning with reference to the front edge of a sheet transported to form images. For example, if a register mark is specified to be formed at a distance of a [mm] from the front edge, the register mark can be formed almost a [mm] away from the front edge, though somewhat different depending on machines. On the other hand, the distance b [mm] between the rear edge of a sheet and a register mark cannot be correctly determined because of an error (e.g., ±1 mm) of sheet lengths, a belt speed error during image writing, and variations in sheet transportation speeds.

As shown in FIG. 8B, in cases where images are formed on both sides by reversing sheets, the reversion of a sheet turns the front edge of a second side thereof in a sheet transportation direction into the rear edge of a first side thereof. As a result, if no adjustment is made, the position of register marks (dashed lines shown in FIG. 8B) formed on the back (first side) of an image formation side (second side) shown in FIG. 8B is b [mm] from the front edge, causing a difference of b−a [mm] with the position (distance a [mm]) of register marks formed on the surface of the image formation side shown in FIG. 8B. If the register marks do not match positionally, a positional mismatch between the surface and the back will cause great problems such as a reference position that cannot be determined when sheets are cut at their ends, and column mismatch between opened pages during bookbinding and the like.

In this case, if the distance b [mm] is a value correctly found, the surface and the back can be registered by adjusting the timing of forming an image on the second side. However, an error of sheet lengths cannot be determined in advance. Particularly if a sheet is allowed to pass through a fixing unit to fix toner images, the sheet stretches by a prescribed length because the sheet is heated while being pressed, and the stretch changes depending on the moisture content of the sheet. Therefore, it is difficult to control registration in advance. For this reason, with the prior arts, it has been impossible to register the surface and the back of sheets with great precision.

SUMMARY OF THE INVENTION

The present invention has been made to solve these technical problems and aims to register both sides of sheets with great precision in the formation of images on the both sides.

An image forming apparatus of the present invention reverses a sheet on a first side of which an image is formed, in reversion transportation paths, and transports it to a transfer unit; measures the distance between the front edge (the rear edge of the first side) of a second side of the sheet transported through the reversion transportation paths and a reference image formed on the first side by a first side read sensor; and reads a reference image held on a transfer member by an image detection sensor when an image is transferred to the second side, wherein a control unit controls the timing of feeding the sheet on the second side of which the image is formed, on the basis of the distance measured using the first side read sensor and the distance between the reference image detected by the image detection sensor and a virtual sheet front edge on the transfer member.

The image forming apparatus further includes a registration roll for transporting the sheet to the transfer unit when the image is transferred to the second side, and the image detection sensor is characterized in that a distance to the transfer unit in the transfer member is longer than the distance between the registration roll and the transfer unit. The control unit controls the rotation timing of the registration roll for transporting the sheet to the transfer unit, thereby controlling the timing of feeding the sheet.

On the other hand, in the image forming apparatus to which the present invention is applied, the control unit controls the timing of writing the image formed on the second side on the basis of a distance measured by the first side read sensor. The reference image formed on the first side is a register mark, and the control unit controls the timing of writing the image in a direction that brings the register mark formed on the first side and a register mark newly formed on the second side into positional match in terms of the surface and the back.

From other standpoints, the present invention is an image forming apparatus that reverses a sheet on a first side of which an image is formed, using reversion transportation paths, and forms an image on a second side of the reversed sheet, wherein, when an image is formed on the first side, a reference image printing part prints a predetermined reference image at a predetermined distance from the rear edge of the first side, using a color component that is difficult for human eyes to identify; a distance measurement part measures a distance between the rear edge of the first side and the reference image with respect to the sheet on which the reference image is printed by the reference image printing part and which is reversed in the reversion transportation paths; and a control part, when an image is formed on the second side, controls the timing of feeding the sheet or the timing of writing the image on the basis of the distance measured by the distance measurement part.

The image forming apparatus to which the present invention is applied includes: an image holding member that holds toner images; an intermediate transfer member that temporarily holds the toner images held in the image holding member; a secondary transfer member that transfers the toner images held in the intermediate transfer member to a sheet in the transfer unit; a registration roll that rotates to the transfer unit in step with sheet feeding timing; a fixing unit that fixes the toner images transferred to a first side of the sheet by the secondary transfer member to the first side of the sheet; reversion transportation paths that reverse the sheet to which the toner images are fixed by the fixing unit and again transport the sheet to the transfer unit; a first sensor that detects the image of the first side of the sheet transported through the reversion transportation paths; and a second sensor that detects the toner images held in the intermediate transfer member, wherein the distance between the second sensor and the transfer unit when viewed from the intermediate transfer member is longer than the sheet transportation distance between the registration roll and the transfer unit.

BRIEF DESCRIPTION OF THE DRAWINGS

A preferred embodiment of the present invention will be described in detail based on the followings, wherein.

DESCRIPTION OF THE PREFERRED EMBODIMENTS

Hereinafter, embodiments of the present invention will be described in detail with reference to the accompanying drawings.

Figure 1:
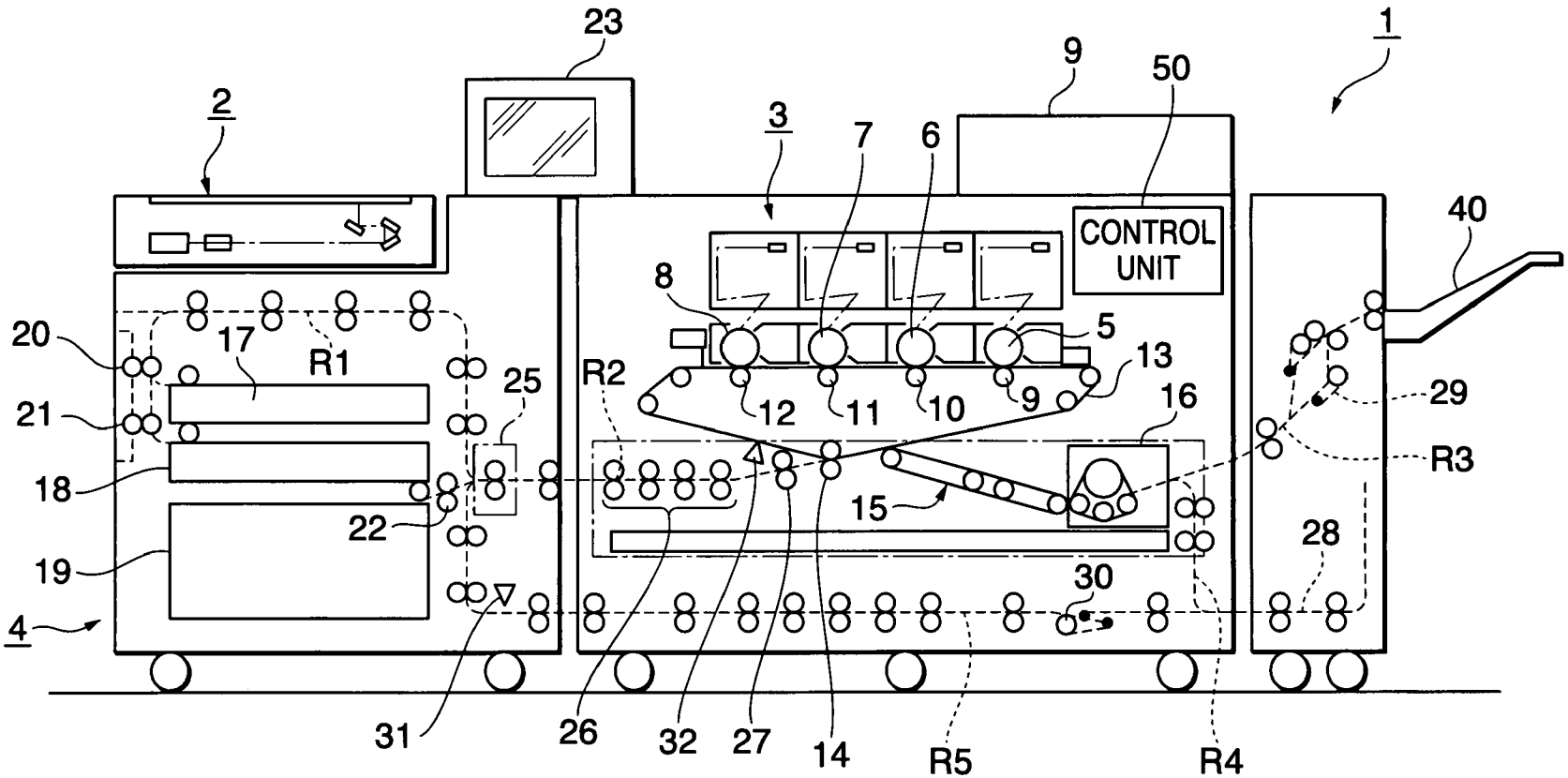
FIG. 1 is a diagram showing an overall configuration of a image forming apparatus to which this embodiment is applied.

FIG. 1 is a diagram showing an overall configuration of an image forming apparatus 1 to which this embodiment is applied. The image forming apparatus capable of outputting full-color images primarily includes: an image read unit 2 that reads an image of an original; an image forming unit 3 that forms an image on a sheet; and a sheet feeding unit 4 that feeds the sheet to the image forming unit 3. The image forming apparatus 1 has a control unit 50 that controls the whole of the image forming apparatus 1.

The image read unit 2 reads an image of an original set on a transparent original base. It includes: an optical scanning system having, e.g., a lamp, mirror, carriage, and the like; a lens system for forming an optical image scanned by the optical scanning system; and an image read sensor such as CCD that receives the optical image formed by the lens system and converts it into an electric signal.

The image forming unit 3 has a so-called four-train tandem configuration that includes: four photoconductive drums 5, 6, 7, and 8 juxtaposed in a horizontal direction correspondingly to yellow (Y), magenta (M), cyan (C), and black (K); four primary transfer rolls 9, 10, 11, and 12 disposed correspondingly to the photoconductive drums 5 to 8; an intermediate transfer belt 13 as an intermediate transfer member (transfer member) to which toner images formed on the photoconductive drums 5 to 8 are successively subjected to primary transfer; a secondary transfer roll 14 that subjects toner images superimposed on the intermediate transfer belt 13 to secondary transfer to sheets in the secondary transfer unit; a vacuum transportation unit 15 that transports sheets having been subjected to the secondary transfer; and a fixing unit 16 that fixes the toner images on the sheets having been subjected to the secondary transfer.

There are respectively disposed in the periphery of the photoconductive drums 5 to 8: electrifiers that evenly electrify the surface of the photoconductive drums 5 to 8; laser writing apparatuses that form static latent images by irradiating laser to the surface of the photoconductive drums 5 to 8 electrified by the electrifiers; developer units that develop static latent images formed on the photoconductive drums 5 to 8 by predetermined color component toners to form visible images; cleaners that eliminate residual toners remaining on the surface of the photoconductive drums 5 to 8 after the primary transfer; and the like. On the other hand, the primary transfer rolls 9 to 12 are disposed in the vicinity of and in opposed relation to the corresponding photoconductive drums 5 to 8 through the intermediate transfer belt 13. The primary transfer rolls 9 to 12 subject toner images formed on the corresponding photoconductive drums 5 to 8 to primary transfer to the intermediate transfer belt 13. The intermediate transfer belt 13 is stretched in a loop form by plural (five in this example) support rolls.

The secondary transfer roll 14 is disposed opposite to the intermediate transfer belt 13. The secondary transfer roll 14 subjects superimposed toner images of different colors successively subjected to primary transfer onto the intermediate transfer belt 13 to secondary transfer (collective transfer) to sheets. The vacuum transportation unit 15 attracts and transports to the fixing unit 16 the sheets to which the toner images have been transferred by the secondary transfer roll 14. The fixing unit 16 fixes the toner images to the sheets by heating and pressing.

On the other hand, the sheet feeding unit 4 transports sheets of different colors housed in a first tray 17, a second tray 18, and a third tray 19 through corresponding transportation paths. In the vicinity of the trays 17 to 19 are disposed feeding rolls 20, 21, and 22 corresponding to them. The feeding rolls 20 to 22 nip sheets taken out one at a time in a separated form from corresponding trays 17 to 19 and temporarily halt them on sheet transportation paths, and at a timing based on a predetermined start signal, feed them to the downstream side of sheet transportation direction. In the vicinity of the image read unit 2 is provided an operation panel 23 operated by users.

Transportation rolls for transporting sheets are disposed in proper positions of sheet transportation paths R1 to R5 extending to a discharge tray 40 via image formation processing positions of the image forming unit 3 from sheet feeding positions of the feeding rolls 20 to 22. A sheet housed in the first tray 17 is fed by the feeding roll 20, then fed to a junction transportation unit 25 via the first sheet transportation path R1. On the other hand, a sheet housed in the third tray 19 is directly fed to the junction transportation unit 25 by the feeding roll 22.

The sheet fed to the junction transportation unit 25 is fed to image formation processing positions of the image forming unit 3 via a second sheet transportation path R2. Further, the sheets passing through the image formation processing positions is fed to the fixing unit 16 by the vacuum transportation unit 15, then discharged to the discharge tray 40 via the third sheet transportation path R3. On the other hand, a sheet on the both sides of which images are formed passes through the fixing unit 16, then fed to a double side reversion unit 28 via a fourth sheet transportation path R4, where the sides of the sheet are reversed, and fed back to the junction transportation unit 25 via a fifth sheet transportation path R5. When the sides of the sheet have been reversed by these reversion transportation paths, the rear edge of the sheet transported to form a first side becomes the front edge of the sheet when the second side is formed.

In the sheet transportation paths R1 to R5, there are disposed a posture correction unit 26 that corrects the posture of sheet transported through the second sheet transportation path R2, and a registration roll 27 that has a pair of rolls held in close contact with each other, and feeds a sheet to the image formation processing positions by rotating the pair of rolls while nipping the sheet between the roll pair. The registration roll 27 is adjusted in terms of sheet arrival timing for image formation processing when feeding the sheet, by a timing adjustment module not shown. The sheet transportation paths R3 and R5 are respectively provided with curl correction units 29 and 30 for correcting sheet curl produced during fixing in the fixing unit 16.

In this embodiment, there are provided a first side read sensor 31 as a first sensor and an image detection sensor 32 as a second sensor. The first side read sensor 31 detect the arrival of the front edge of a sheet reversed in side through the fourth and fifth paper transportation paths R4 and R5, and detects register marks formed on the first side and the positions of reference images. The image detection sensor 32 detects register marks superimposed on the intermediate transfer belt 13 and toner images of reference images. The register mark is a reference mark used in the printing industry and the like to register multiple color plates. The register marks include a center register mark, a fold register mark, and a cut register mark. These register marks are formed as lines having a predetermined length in a direction (fast-scan direction) orthogonal to a sheet transportation direction and in a sheet transportation direction (slow-scan direction). The image forming apparatus 1 can form images on a sheet as reference positions of cutting lines when the sheet after image formation is cut. According to cut positions, users can freely specify, e.g., 5 mm, 10 mm, and 15 mm from the front edge of a sheet. The setting can be performed by a computer apparatus (not shown) connected to the image forming apparatus 1.

The distance between the image detection sensor 32 and the secondary transfer unit (the position where the intermediate transfer belt 13 and the secondary transfer roll 14 abut against each other) on the intermediate transfer belt 13 is longer than the distance between the registration roll 27 and the secondary transfer unit, e.g., by 5 mm or more. This setting enables control of registration feeding timing of a second side (registration timing in a lead direction (sheet transportation direction)) as described later. The image forming unit 3 in this embodiment functions as one of reference image printing units that print given reference images.

Next, a description is made of the control unit 50 to which this embodiment is applied.

Figure 2:
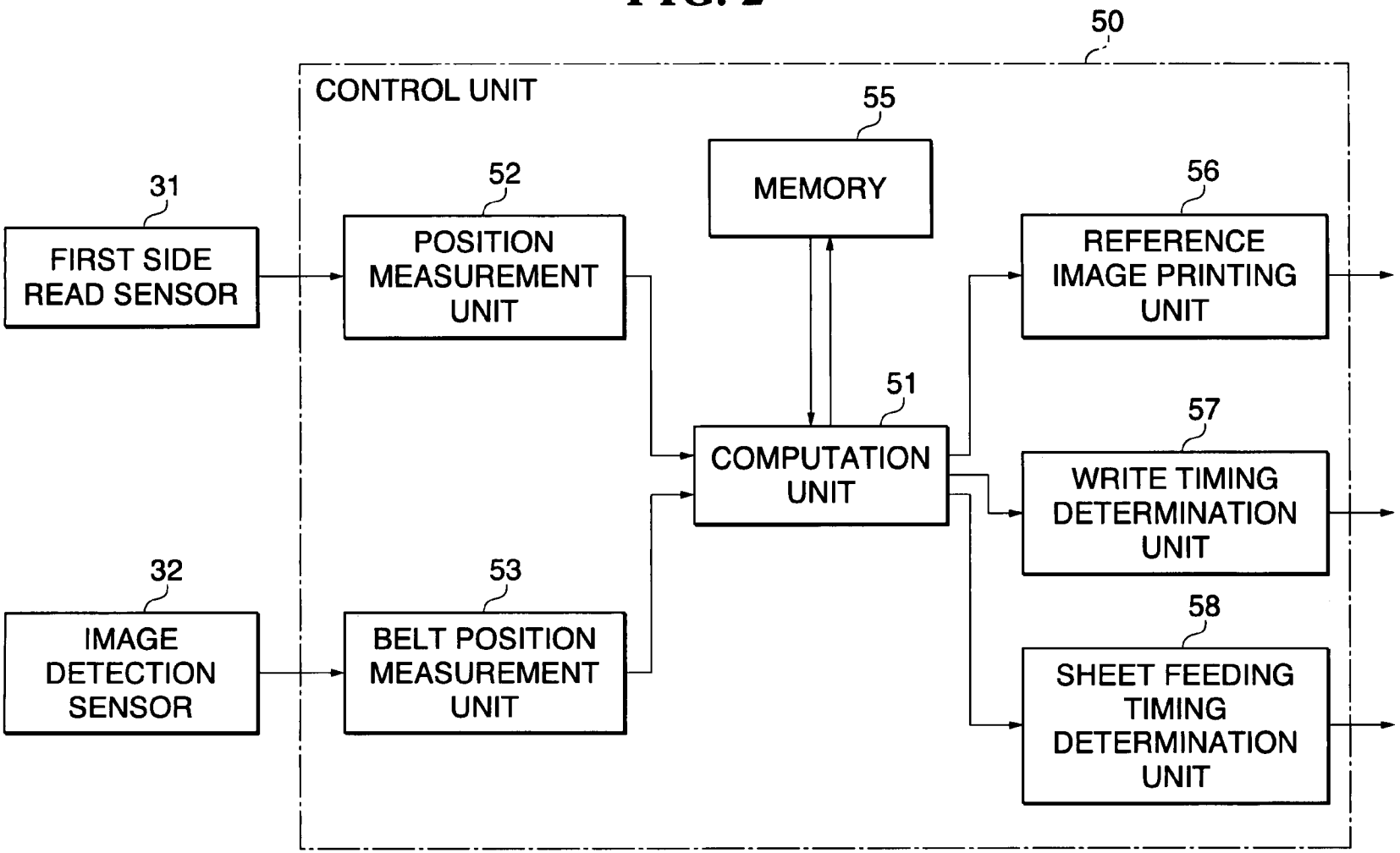
FIG. 2 is a block diagram showing the configuration of a control unit.

FIG. 2 is a block diagram showing the configuration of the control unit 50. The control unit 50, as shown in FIG. 2, includes: a computation unit 51 that computes correction values and the like; a position measurement unit 52 that measures a positional relationship between the front edge of a sheet and an image on the basis of values read from the first side read sensor 31; a belt position measurement unit 53 that measures a positional relationship of an image to be formed on a second side on the basis of values read from the image detection sensor 32; a memory 55 that stores results of computations by the computation unit 51, design values (normal values), and the like; a reference image printing unit 56 for printing register marks and other reference images; a write timing determination unit 57 that determines a timing of write to a second side on the basis of results of computations by the computation unit 51; and a sheet feeding timing determination unit 58 that determines a timing of feeding a sheet of a second side on the basis of results of computations by the computation unit 51. As shown in FIG. 1, the first side read sensor 31 detects sheets and register marks (reference images) from inside the reversion transportation paths. Therefore, the position measurement unit 52 can determine the distance between the rear edge of the first side (the front edge of the second side) and a register mark (reference image) formed on the first side on the basis of output from the first side read sensor 31.

Next, a description is made of the flow of processing performed in the control unit 50.

Figure 3:
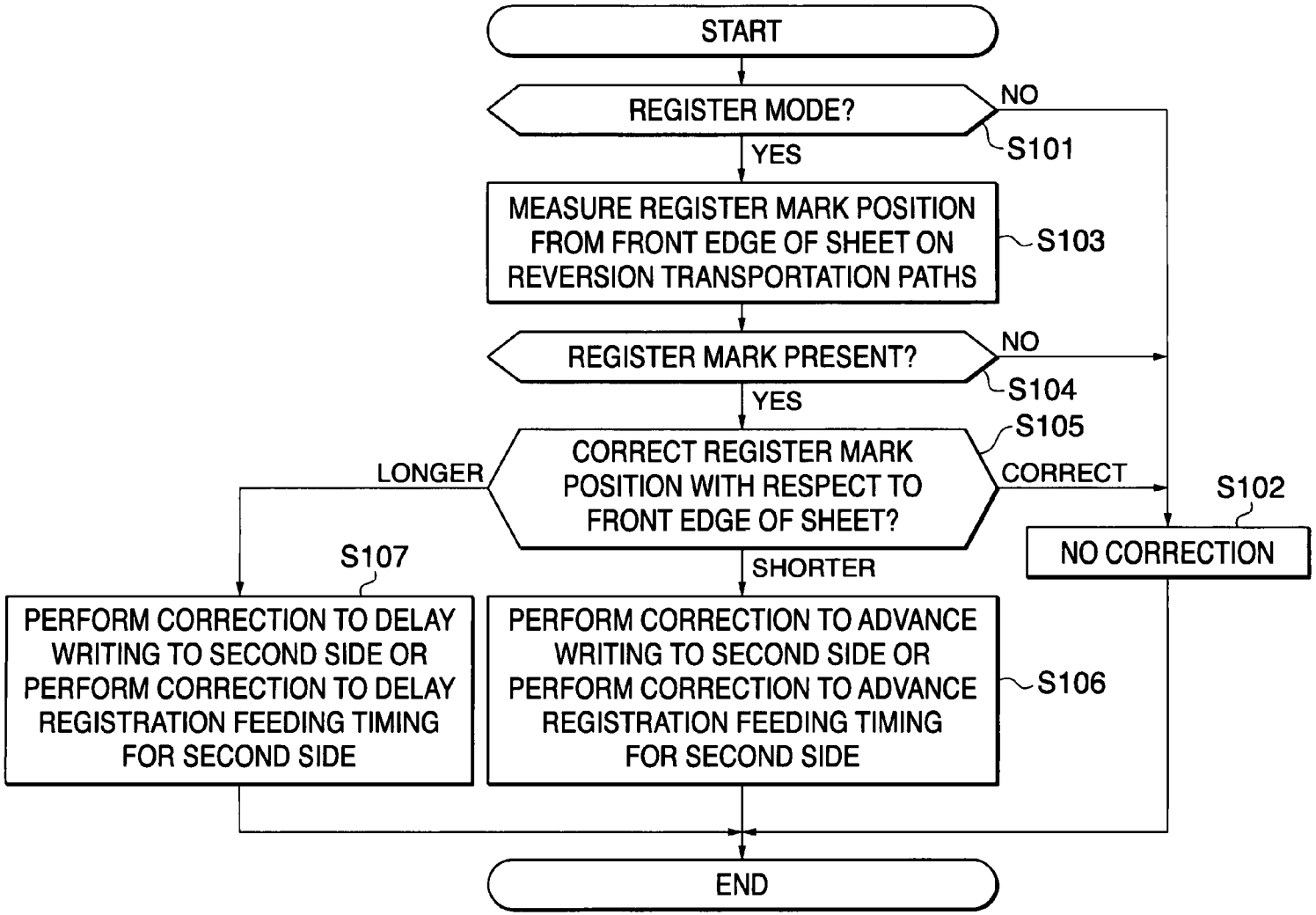
FIG. 3 is a flowchart showing basic processing performed in the control unit.

FIG. 3 is a flowchart showing basic processing performed in the control unit 50. The control unit 50 determines whether the system is in a register mode (step 101). The position of a register mark can be freely set by users. Providing reference signals for normal sampling may cause problems. Accordingly, selection between the register mode and a normal control mode can be specified by the user, using the operation panel 23 and a computer apparatus (not shown) connected over a network. If the system is not in the register mode in the step 101, no correction is performed (step 102), and processing terminates. "No correction is performed" means that correction by register marks is not performed; for example, registration feeding timing control based on setting values stored in advance in the memory 55 (sheet feeding timing control by the registration roll 27) can be performed.

If the register mode is selected in the step 101, the position measurement unit 52 of the control unit 50 measures the position of a register mark from the front edge of a sheet on the basis of output from the first side read sensor 31 provided in the reversion transportation paths (step 103). More specifically, after detecting that the front edge of a sheet has passed through the first side read sensor 31, the position measurement unit 52 detects a timing in which a register mark drawn with a predetermined length in the fast-scan direction passes through the first side read sensor 31.

Processing differs depending on whether a register mark exists (step 104). If no register mark exists, no correction is performed (step 102), and processing terminates. If a register mark exists, it is determined by the computation unit 51 whether the register mark is correctly positioned with respect to the front edge of the sheet (step 105). More specifically, a normal value (design value) stored in the memory 55 and a value measured by the position measurement unit 52 are compared by the computation unit 51. As a result of the computation, if it is determined that the registration is correct, no correction is performed (step 102), and processing terminates. If the measured value is shorter than the normal value, correction is performed by the write timing determination unit 57 to advance the timing of writing to the second side, or correction is performed by the sheet feeding timing determination unit 58 to advance the timing of registration feeding for the second side (step 106), and processing terminates. On the other hand, if it is determined in the step 105 that the measured value is longer than the normal value, correction is performed by the write timing determination unit 57 to delay the timing of writing to the second side, or correction is performed by the sheet feeding timing determination unit 58 to delay the timing of registration feeding for the second side (step 107), and processing terminates.

In this way, the position measurement unit 52 in this embodiment detects the distance between the rear edge of the sheet and a register mark on the first side thereof, using the first side read sensor 31 provided on the reversion transportation paths (e.g., 5 mm). The computation unit 51 computes a difference with the distance between the rear edge of the sheet and a register mark on the second side thereof on the basis of values stored in the memory 55. If a desired value is, e.g., 4 mm, a difference is 1 mm (=5−4). If the difference is a positive value, the timing of writing a register mark for the second side (writing for image formation for the second side) is delayed. Alternatively, sheet feeding for the second side (sheet feeding timing by the registration roll 27) is delayed. This enables registration of the sheet side and the second side, thereby enabling registration of the first side and the second side in a sheet transportation direction.

To detect a register mark of the first side before writing the second side, it is desirable to make measurement before timing of image formation on the second side, that is, immediately after output from the fixing unit 16. In some cases, it is also effective to measure the distance between a register mark and the rear edge of the sheet and a register mark on the first side thereof before reversion. However, since the sheet expands immediately after output from the fixing unit 16, an error may occur. On the other hand, the method of delaying sheet feeding is excellent in that measurement may be made immediately before entry of the sheet to the registration roll 27 and an error is small.

Figure 4:
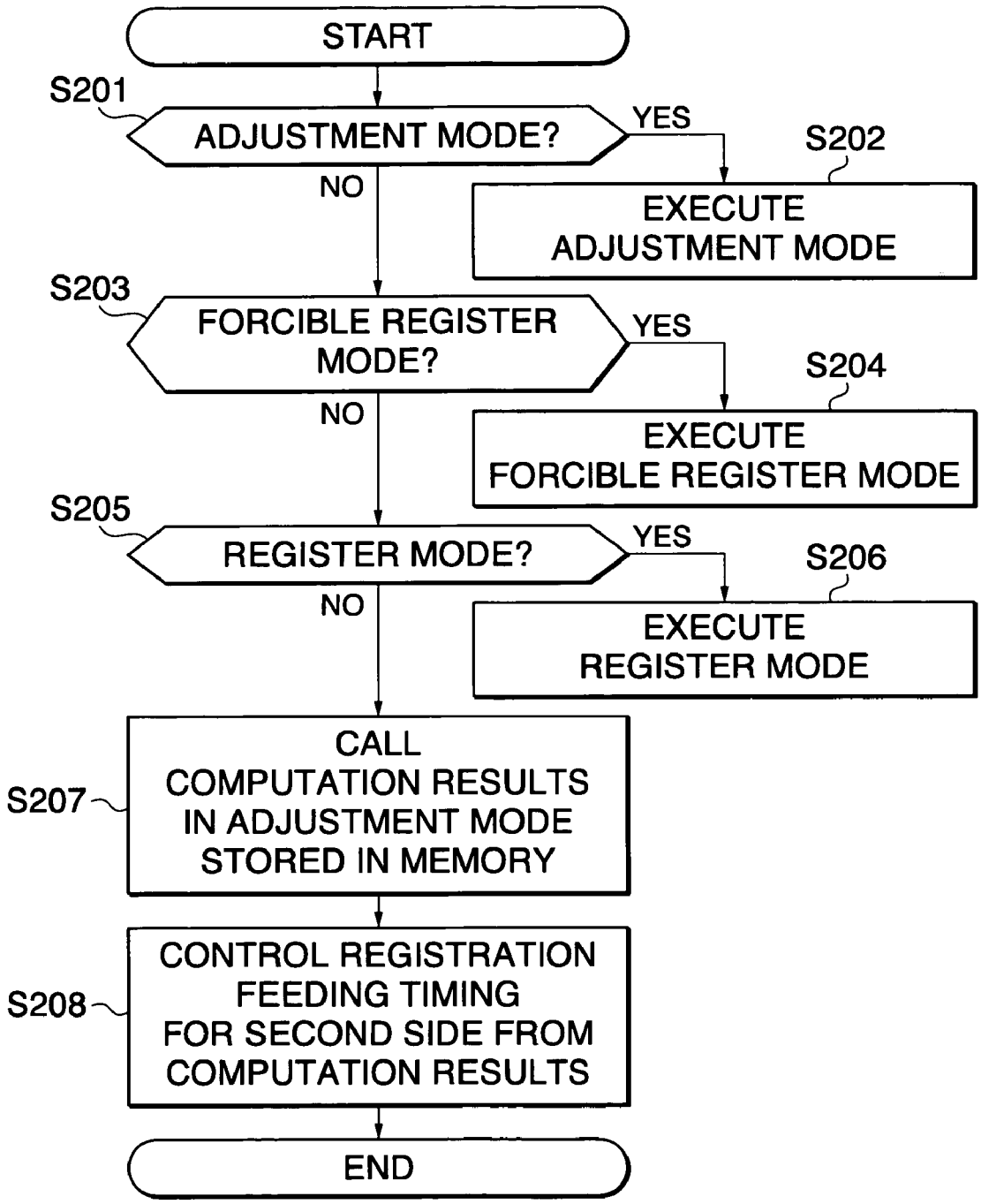
FIG. 4 is a flowchart showing the flow of processing performed using the basic processing flow shown in FIG. 3.

FIG. 4 is a flowchart showing the flow of processing performed using the basic processing flow shown in FIG. 3. The control unit 50 determines whether the system is in an adjustment mode, by a command from the user (step 201). The adjustment mode is executed during transportation and installation, and maintenance of the apparatus, during change of sheets frequently used, or at the time of required adjustment. If it is determined in step 201 that the system is in the adjustment mode, the adjustment mode as described later is executed (step 202). If the system is not in the adjustment mode, it is determined whether the system is in a forcible register mode (step 203). In the forcible register mode, a reference image typified by a register mark is forcibly printed at the rear edge of an image on the first side, and registration feeding timing is controlled on the basis of the forcibly printed image. If it is determined whether the system is in the forcible register mode in step 203, the forcible register mode is executed (step 204). If the system is not in the forcible register mode, it is determined whether the system is in the register mode (step 205). If the system is in the register mode, the register mode is executed (step 206). If the system is not in the register mode, computation results in the adjustment mode (step 202), stored in the memory 55, are called (step 207), and registration feeding timing is controlled by the timing determination unit 58 on the basis of the computation results (step 208), and processing terminates. In the register mode, in addition to basic processing described in FIG. 3, processing (described later) with correction for the intermediate transfer belt 13 taken into account can be performed.

Processing of the adjustment mode is described.

Figure 5:
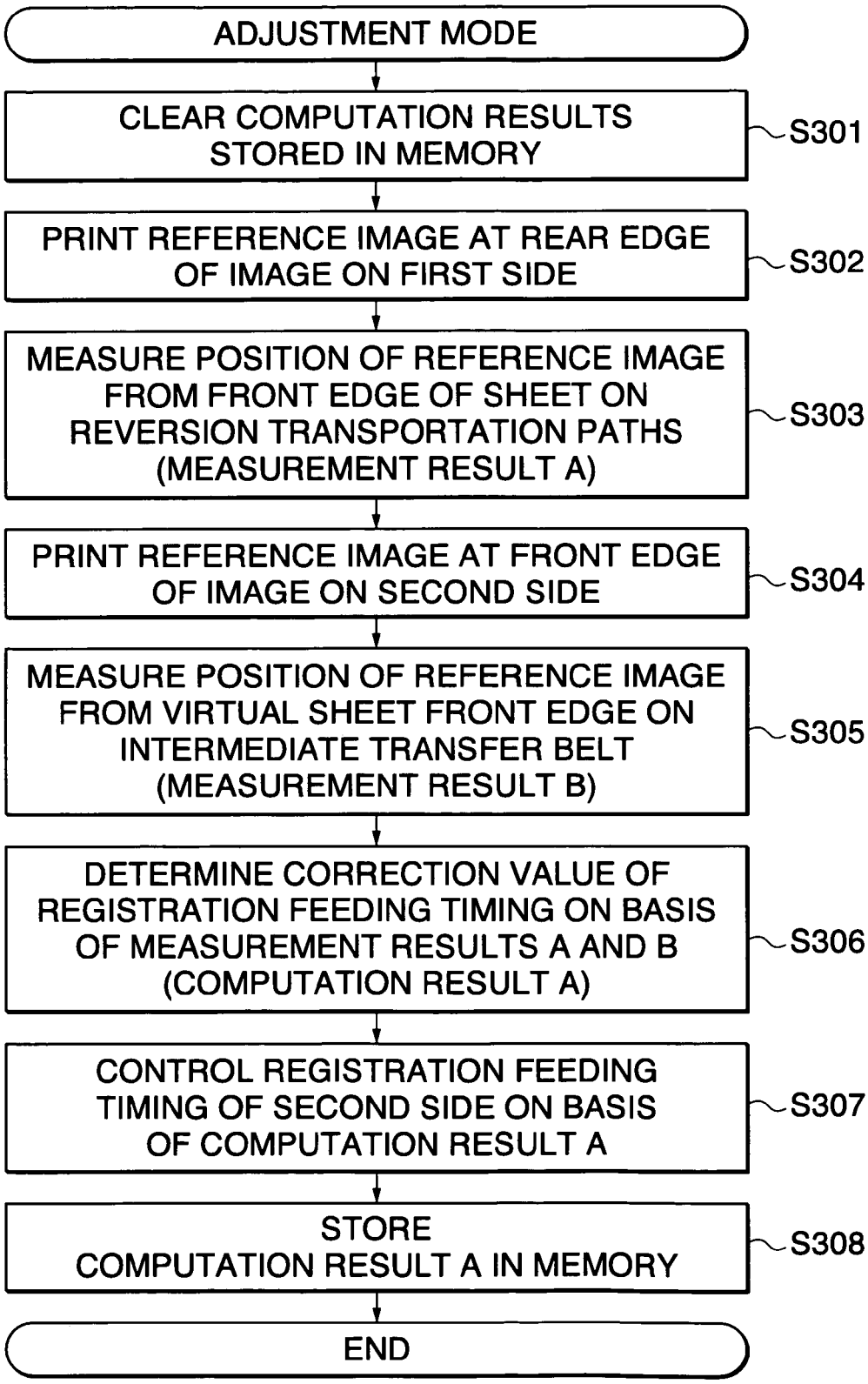
FIG. 5 is a flowchart showing processing of an adjustment mode.

FIG. 5 is a flowchart showing processing of the adjustment mode shown in step 202 of FIG. 4. In the adjustment mode, the control unit 50 clears the computation results stored in the memory 55 (step 301). The reference image printing unit 56 prints a reference image at the rear edge of an image on the first side (step 302). After the image on the first side is formed on a sheet and passes through the fixing unit 16, the position of the reference image from the front edge of the sheet is measured on the reversion transportation paths by the position measurement unit 52 on the basis of output from the first side read sensor 31 (step 303). Let the measurement result be measurement result A.

Thereafter, according to a command from the reference image printing unit 56, the reference image is printed at the front edge of the image on the second side (step 304). Before subjecting the image on the second side to secondary transfer to the sheet, the position of the reference image from a virtual sheet front edge on the intermediate transfer belt 13 is measured by the belt position measurement unit 53 on the basis of output from the image detection sensor 32 (step 305). Let the measurement result be measurement result A. The computation unit 51 determines a correction value of registration feeding timing on the basis of the measurement results A and B (step 306). Let the computation result be computation result B. The sheet feeding timing determination unit 58 controls registration feeding timing of the second side on the basis of the computation result A (step 307). The computation result A is stored in the memory 55 (step 308), and processing terminates.

The virtual sheet front edge on the intermediate transfer belt 13 is determined on the basis of belt transportation timing from the distance between the image detection sensor 32 and the secondary transfer unit. The intermediate transfer belt 13 may change in belt length depending on changes in temperature. As a result, the position of the virtual sheet front edge and the position of a register mark formed may not match design values. Accordingly, it is desirable that the sheet feeding timing determination unit 58 controls registration feeding timing, considering the position of the reference image formed on the intermediate transfer belt 13.

Next, the force register mode is described.

Figure 6:
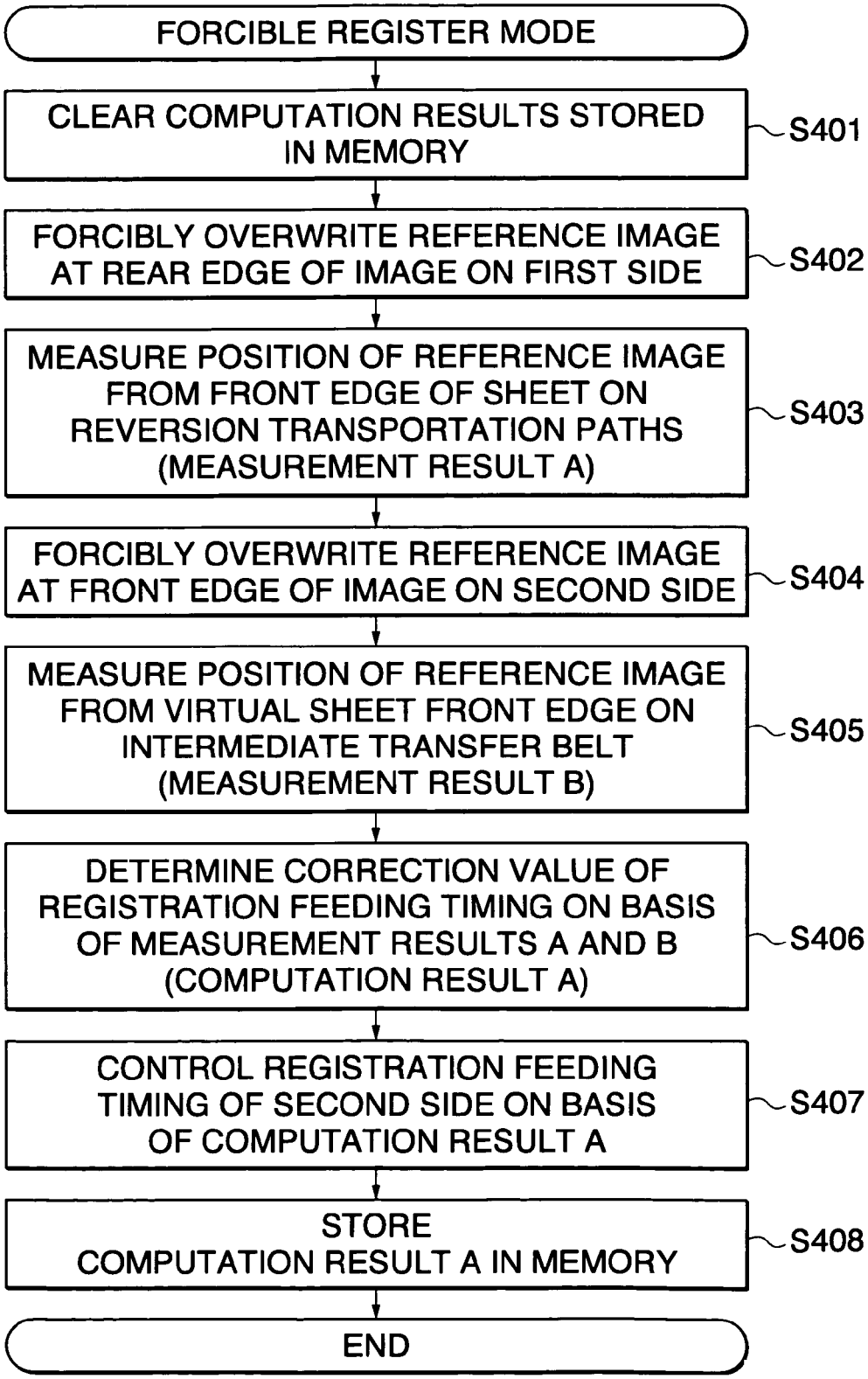
FIG. 6 is a flowchart showing processing of a forcible register mode.

FIG. 6 is a flowchart showing processing of the forcible register mode shown in step 203 of FIG. 4. In the register mode, the control unit 50 clears the computation results stored in the memory 55 (step 401). The reference image printing unit 56 forcibly overwrites the reference image at the rear edge of the image on the first side (step 402). After the image on the first side is formed on the sheet and passes through the fixing unit 16, the position measurement unit 52 measures the position of the reference image from the front edge of the sheet on the reversion transportation paths on the basis of output from the first side read sensor 31 (step 403). Let the measurement result be measurement result A.

Thereafter, according to a command from the reference image printing unit 56, the reference image is forcibly overwritten at the front edge of the image on the second side (step 404). Before subjecting the image on the second side to secondary transfer to the sheet, the position of the reference image from a virtual sheet front edge on the intermediate transfer belt 13 is measured by the belt position measurement unit 53 on the basis of output from the image detection sensor 32 (step 405). Let the measurement result be measurement result B. The computation unit 51 determines a correction value of registration feeding timing on the basis of the measurement results A and B (step 406). Let the computation result be computation result A. The sheet feeding timing determination unit 58 controls registration feeding timing of the second side on the basis of the computation result A (step 407). The computation result A is stored in the memory 55 (step 408), and processing terminates.

In the forcible register mode, the reference image, without being limited to a register mark, may be other images that can be read by the first side read sensor 31 and the image detection sensor 32. When images on both sides are formed by the image forming unit 3, an image produced in a color component such as yellow that is difficult for human eyes to identify may be used as a reference image and printed to register both sides. In such a case, it is necessary to use a sensor capable of discriminating yellow in the first side sensor 31 and the like. Further, a reference image may be printed in any places suitable for measurement such as areas where images are infrequently printed or will not be printed, that is, regions in which normal images are not printed, or areas considered to usually contain a small amount of image information. To achieve registration from the front edge of a second side, it is desirable that a reference image of a predetermined shape is formed at a predetermined distance from the rear edge of the first side.

Next, the registration mode is described.

Figure 7A:
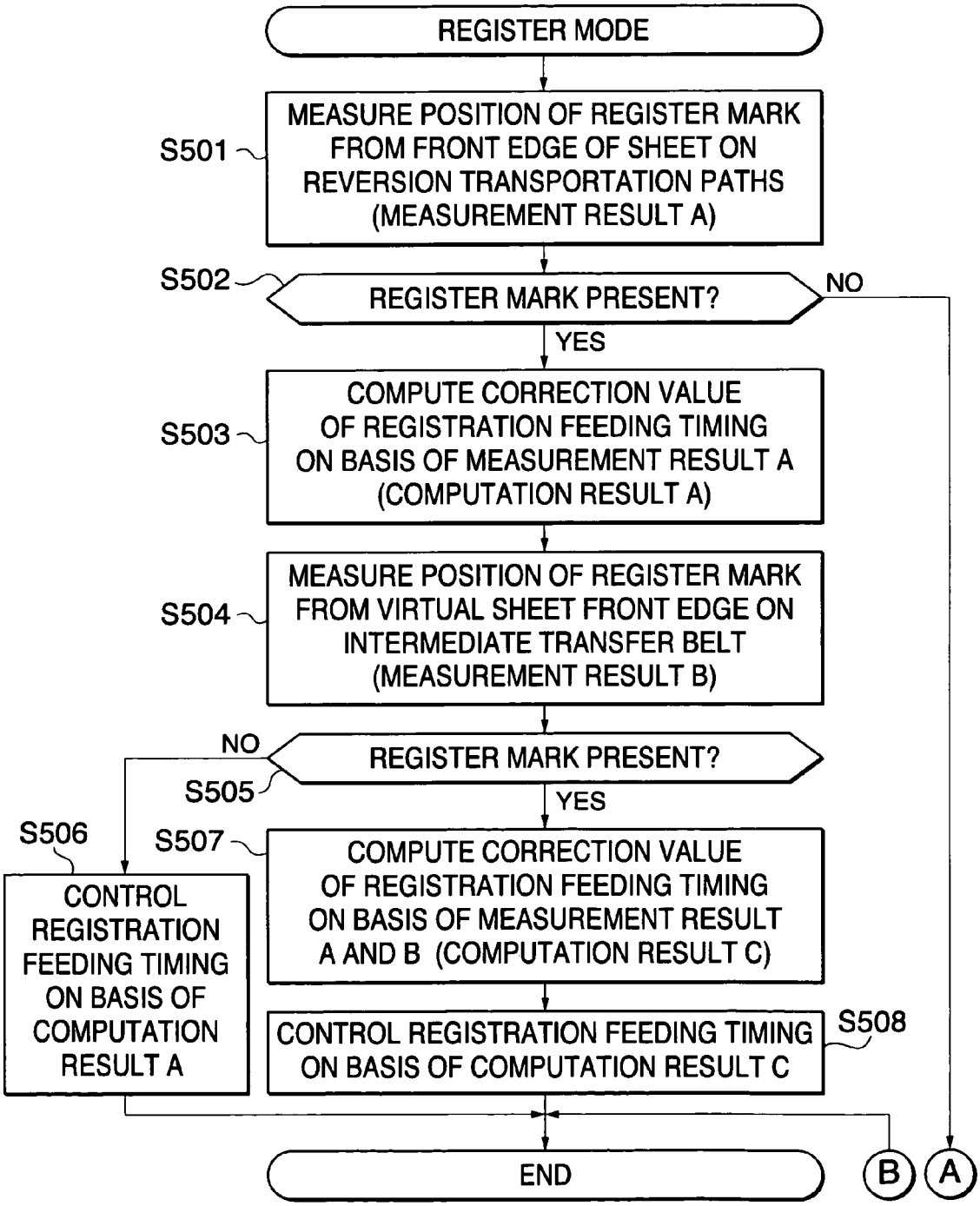
FIG. 7 is a flowchart showing processing of a register mode.
Figure 7B:
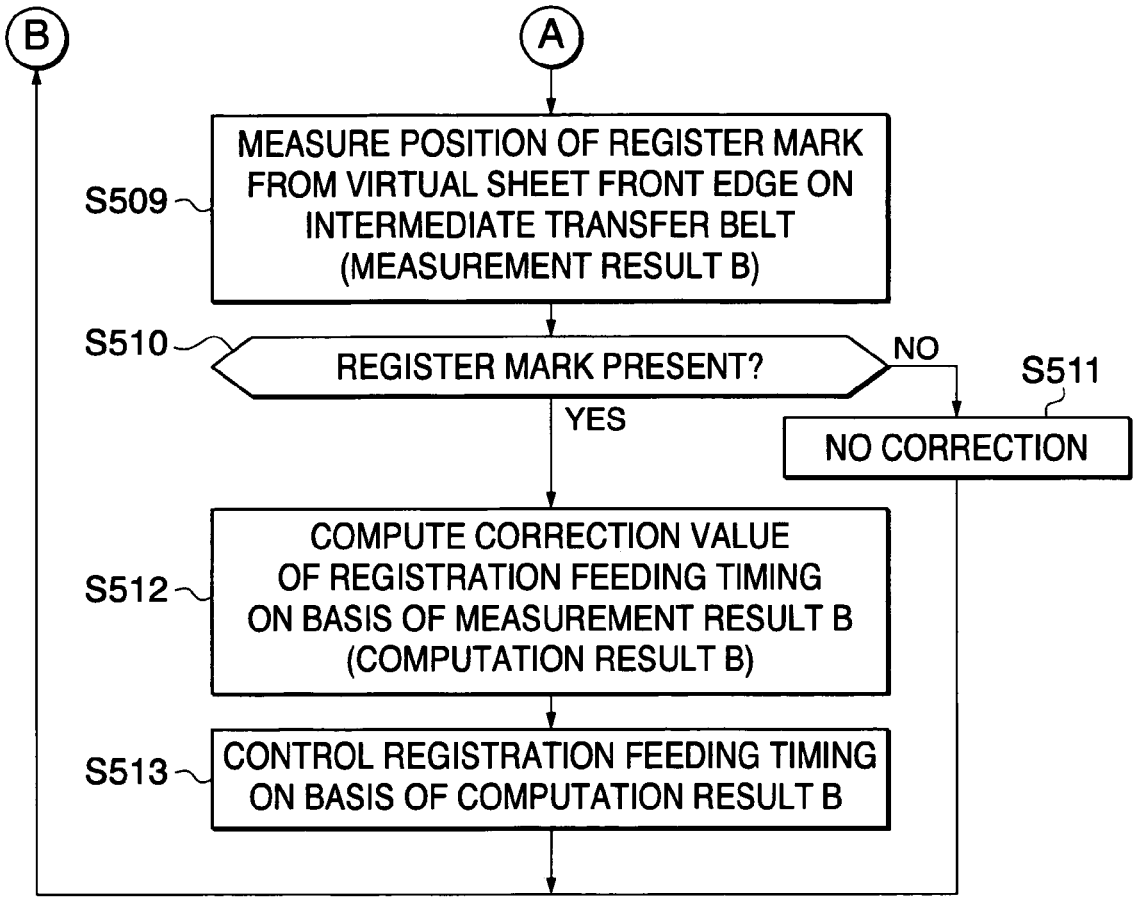
Figure 8A:
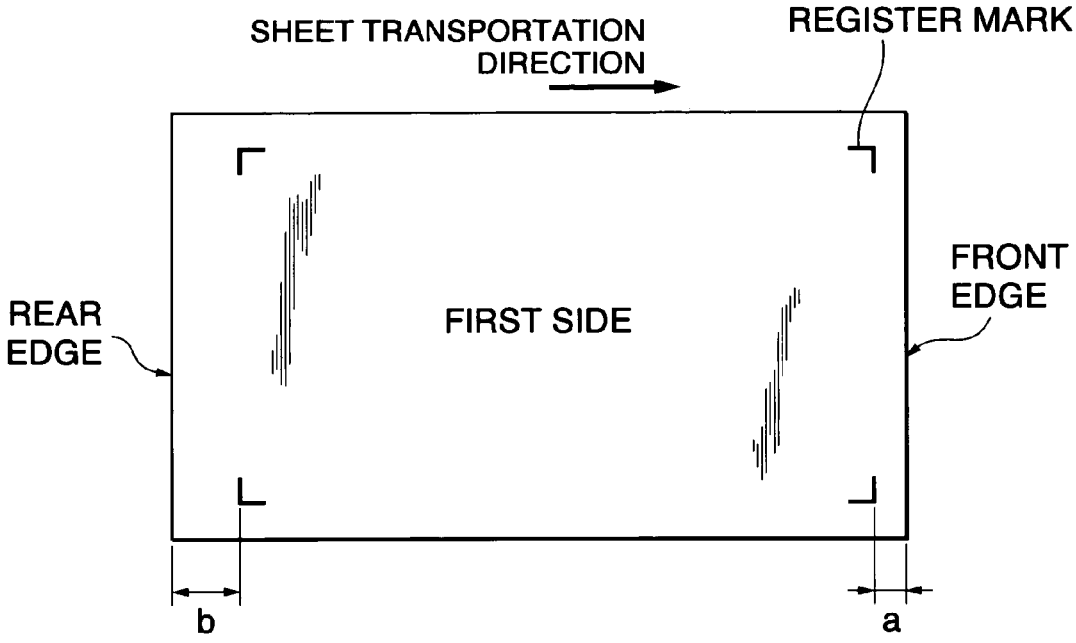
FIG. 8A PRIOR ART
FIGS. 8A and 8B are diagrams for explaining problems in the formation of images on both sides of a sheet.
Figure 8B:
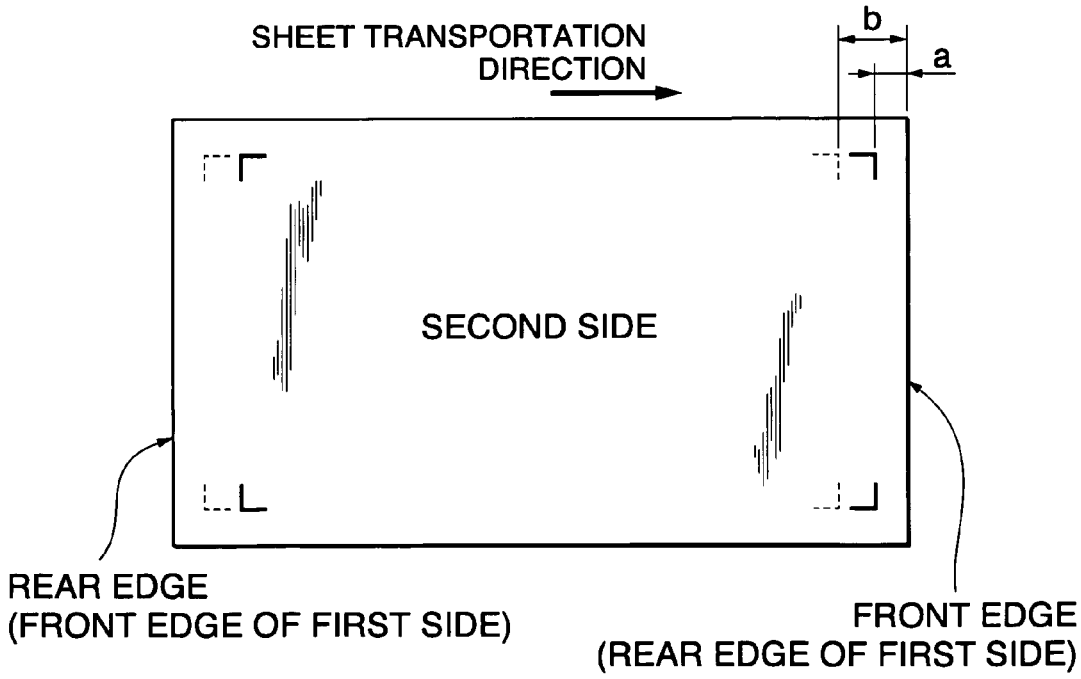
FIG. 8B PRIOR ART

FIG. 7 is a flowchart showing processing of the register mode shown in step 205 of FIG. 4. This processing flow includes measurement of a register mark from a virtual sheet front edge on the intermediate transfer belt 13 in the basic processing flow shown in FIG. 3. The position measurement unit 52 of the control unit 50 measures the position of a register mark formed on the first side from the front edge (the rear edge of the first side) of the second side of the sheet on the basis of output from the first read sensor 31 provided on the reversion transportation paths (step 501). Let the measurement result be measurement result A. Processing differs depending on whether a register mark exists (step 502). If a register mark exists, the computation unit 51 computes a correction value of registration feeding timing on the basis of the measurement result A (step 503). Let the computation result be computation result A. Next, the belt position measurement unit 53 measures the position of the register mark from a virtual sheet front edge on the intermediate transfer belt 13 (step 504), using detection from the image detection sensor 32. Let the measurement result be measurement result B.

Processing differs depending on whether a register mark exists on the intermediate transfer belt 13 (step 505). If no register mark exists on the intermediate transfer belt 13, the sheet feeding timing determination unit 58 controls registration feeding timing on the basis of the computation result A (step 506), and processing terminates. If it is determined in the step 505 that the register mark exists on the intermediate transfer belt 13, the computation unit 51 computes a registration feeding timing correction value on the basis of the measurement results A and B (step 507). Let the computation result be computation result C. The sheet feeding timing determination unit 58 controls registration feeding timing on the basis of the computation result C (step 508), and processing terminates.

On the other hand, in the step 502, if no register mark exists on the first side of the sheet, the belt position measurement unit 53 measures the position of the register mark from a virtual sheet front edge on the intermediate transfer belt 13 (step 509), using detection from the image detection sensor 32. Let the measurement result be measurement result B. Processing differs depending on whether a register mark exists on the intermediate transfer belt 13 (step 510). If no register mark exists on the intermediate transfer belt 13, no connection is performed (step 511), and processing terminates. If a register mark exists, the computation unit 51 computes a registration feeding timing correction value on the basis of the measurement result B (step 512). Let the computation result be computation result B. The sheet feeding timing determination unit 58 controls the registration feeding timing on the basis of the computation result B (step 513), and processing terminates. Although processing terminates without performing correction in step 511, computation results in the adjustment mode, stored in the memory 55, may be called to control the registration feeding timing of the second side on the basis of the computation results, as in the steps 207 and 208 shown in FIG. 4.

In this way, in processing shown in FIG. 7, registration feeding timing on the second side by use of the registration roll 27 is performed by use of, as a trigger, a register mark held on the intermediate transfer belt 13. Although the positions of the sheet front edge of the second side and a register mark are somewhat changeable despite under control, by performing the above-described processing, the positions of the sheet front edge of the second side and a register mark can be controlled so as to be more stable.

As has been described above, according to this embodiment, in the image forming apparatus 1 reversing sheets to form images on both sides thereof, first and second sides can be almost correctly registered in a sheet transportation direction, and positional mismatch of the both sides caused by sheet type and moisture condition, incorrect sheet cut dimensions, and the like can be suppressed.

This embodiment has been described centering on cases where registration is adjusted during formation of images on both sides by use of register marks. However, instead of the register marks, other reference images may be used for registration. The reference images can be freely formed by the image forming apparatus 1, and colors and formation positions of reference images formed can also be freely set by the image forming apparatus 1. As described previously, if color components such as yellow that are difficult for human eyes to identify are used to form a reference image, even if the reference image is printed on print images to be formed, desirably, the print images are never badly affected, and yet images on both sides can be correctly registered. Although, in this embodiment, the first side read sensor 31 is used to read a sheet front edge of a second side and a reference image on a first side, a sensor for reading a sheet front edge and a sensor for reading a reference image may be provided separately.

As has been described above, according to the present invention, in formation of images on both sides, the both sides can be precisely registered (registered in a sheet transportation direction, namely, lead direction).

In the image forming apparatus in which register marks are formed, when images are formed on both sides, register marks on the surface and back can be precisely registered.

The entire disclosure of Japanese Patent Application No. 2003-071290 filed on Mar. 17, 2003 including specification, claims, drawings and abstract is incorporated herein by reference in its entirety.

What is claimed is:

1. An image forming apparatus comprising:

a reversion transportation path that reverses a sheet on a first side of which an image is formed, and transports it to a transfer roll;

a first side read sensor that is located at the reversion transportation path and measures a distance between a front edge of a second side of the sheet transported through the reversion transportation path and a reference image formed on the first side of the sheet;

a control unit that controls a timing of feeding the sheet image is formed, on the basis of the distance measured using the first side read sensor; and an image detection sensor that reads the reference image held on a transfer member when an image is transferred to the second side of the sheet, wherein the reference image on the first side makes a positional match with a reference image on the second side.

2. An image forming apparatus comprising:

a reversion transportation path that reverses a sheet on a first side of which an image is formed, and transports it to a transfer unit roll;

a first side read sensor that is located at the reversion transportation path and measures a distance between a front edge of a second side of the sheet transported through the reversion transportation path and a reference image formed on the first side of the sheet;

a control unit that controls a timing of feeding the sheet on the second side of which an image is formed, on the basis of the distance measured using the first side read sensor; and an image detection sensor that reads a reference image held on a transfer member when an image is transferred to the second side of the sheet, wherein the control unit controls the timing of feeding the sheet on the basis of a distance between the reference image detected by the image detection sensor and a virtual sheet front edge on the transfer member.

3. The image forming apparatus according to claim 2, further comprising a registration roll that transports the sheet to the transfer roll when the image is transferred to the second side of the sheet, wherein a distance between the image detection sensor and the transfer roll in the transfer member is longer than a distance between the registration roll and the transfer roll.

4. The image forming apparatus according to claim 3, wherein the control unit controls a rotation timing of the registration roll for transporting the sheet to the transfer roll, thereby controlling the timing of feeding the sheet.

5. The image forming apparatus according to claim 1, wherein the reference image formed on the first side of the sheet is a register mark.

6. An image forming apparatus comprising:

a reversion transportation path that reverses a sheet on a first side of which an image is formed, and transports it to a transfer unit;

a first side read sensor that is located at the reversion transportation path and measures a distance between a front edge of a second side of the sheet transported through the reversion transportation path and a reference image formed on the first side of the sheet;

a control unit that controls a timing of writing an image formed on the second side of the sheet, on the basis of the distance measured using the first side read sensor; and an image detection sensor that reads the reference image held on a transfer member when an image is transferred to the second side of the sheet, wherein the reference image on the first side makes a positional match with a reference image on the second side.

7. The image forming apparatus according to claim 6, wherein the reference image formed on the first side of the sheet is a register mark, and the control unit controls the timing of writing the image in a direction that brings the register mark formed on the first side of the sheet and a register mark newly formed on the second side of the sheet into positional match.

8. An image forming apparatus that reverses a sheet on a first side of which an image is formed, using a reversion transportation path, and forms an image on a second side of the sheet, the image forming apparatus comprising:

a reference image printing part that, when an image is formed on the first side of the sheet, prints a predetermined reference image at a predetermined distance from a rear edge of the first side of the sheet;

a distance measurement part that is located at the reversion transportation path and measures a distance between the rear edge of the first side of the sheet and the reference image with respect to the sheet on which the reference image is printed by the reference image printing part and which is reversed by the reversion transportation path;

a control part that, when an image is formed on the second side of the sheet, controls a timing of feeding the sheet or a timing of writing the image on the basis of the distance measured by the distance measurement part; and an image detection sensor that reads the reference image held on a transfer member when an image is transferred to the second side of the sheet, wherein the reference image on the first side makes a positional match with a reference image on the second side.

9. The image forming apparatus according to claim 8, wherein the reference image printing part uses a color component that is difficult for human eyes to identify.

10. The image forming apparatus according to claim 8, wherein the reference image printing part prints the predetermined reference image in an area that is at least one of an area where images are infrequently printed and an area where images will not be printed.

11. An image forming apparatus forming an image on a first side and a second side of a recording medium comprising:

a reversion transportation path that reverses the recording medium;

a sensor located at the reversion transportation path for sensing a distance between an end of the recording medium, on the first side of which an image is formed, and a reference image formed on the recording medium;

a controller for controlling a position for forming an image on the second side of the recording medium on the basis of the distance measured by the sensor; and an image detection sensor that reads the reference image held on a transfer member when an image is transferred to the second side of the sheet, wherein the reference image on the first side makes a positional match with a reference image on the second side.

12. An image forming method comprising:

transferring a sheet reversed in a reversion transportation path, an image being formed on a first side of the sheet;

measuring, at the reversion transportation path, a distance between a front edge of a second side of the sheet transported through the reversion transportation path and a reference image formed on the first side of the sheet by a first side read sensor;

controlling a timing of feeding the sheet on the second side of the sheet on which an image is formed, on the basis of the distance measured by the first side read sensor; and an image detection sensor that reads the reference image held on a transfer member when an image is transferred to the second side of the sheet, wherein the reference image on the first side makes a positional match with a reference image on the second side.

13. The image forming apparatus according to claim 1, further comprising a position measurement unit that measures a positional relationship between the front edge of the sheet and the image on the basis of values read from the first side read sensor.

* * * * *